US008763824B2

(12) United States Patent
Alcock

(10) Patent No.: US 8,763,824 B2
(45) Date of Patent: Jul. 1, 2014

(54) SYSTEM FOR HANGING AND STORING X-RAY LEAD APRONS

(76) Inventor: Mark A. Alcock, Kinston, NC (US)

( * ) Notice: Subject to any disclaimer, the term of this patent is extended or adjusted under 35 U.S.C. 154(b) by 419 days.

(21) Appl. No.: 13/067,577

(22) Filed: Jun. 10, 2011

(65) Prior Publication Data

US 2011/0315722 A1 Dec. 29, 2011

Related U.S. Application Data

(60) Provisional application No. 61/357,632, filed on Jun. 23, 2010.

(51) Int. Cl.
*A47B 43/00* (2006.01)

(52) U.S. Cl.
USPC ..... 211/206; 248/129; 211/85.3; 280/79.3; 223/85

(58) Field of Classification Search
USPC ..... 248/129; 211/87.01, 96, 99, 100, 104, 211/85.5, 41.15, 41.16, 197, 85.3, 204, 206, 211/13.01, 27; 280/79.3; 223/85
See application file for complete search history.

(56) References Cited

U.S. PATENT DOCUMENTS 2,929,590 A * 3/1960 Thomas ..... 248/647
4,109,794 A * 8/1978 Samuel et al. ..... 211/85.3
5,033,630 A * 7/1991 Lee ..... 211/96
D360,547 S * 7/1995 Chaparro et al. ..... D6/466
D370,139 S * 5/1996 Chaparro et al. ..... D6/466
6,206,210 B1 * 3/2001 Reed ..... 211/96
6,431,374 B1 * 8/2002 Winikoff ..... 211/87.01
7,025,215 B2 * 4/2006 Bain et al. ..... 211/85.31
7,350,680 B2 * 4/2008 DeBroeck ..... 223/87
7,455,186 B2 * 11/2008 Gregory ..... 211/85.3
7,578,400 B1 * 8/2009 Hartman, Sr. ..... 211/27
7,942,747 B2 * 5/2011 Cole ..... 463/47
8,020,716 B2 * 9/2011 Vitale ..... 211/197
8,146,784 B1 * 4/2012 Calanca et al. ..... 223/94
2002/0101047 A1 * 8/2002 Drury Chesser ..... 280/47.35
2004/0150177 A1 * 8/2004 Thiede et al. ..... 280/79.3
2004/0181963 A1 * 9/2004 Morris ..... 34/103
2006/0191965 A1 * 8/2006 DeBroeck ..... 223/85
2007/0184339 A1 * 8/2007 Scheucher ..... 429/99
2012/0018463 A1 * 1/2012 Liberti ..... 223/85
2012/0137534 A1 * 6/2012 Barnard ..... 34/72
2013/0037503 A1 * 2/2013 Cimino et al. ..... 211/85.3

OTHER PUBLICATIONS

Burlington Medical Supplies advertisement, Oct. 2010.

* cited by examiner

*Primary Examiner* — Jerry Redman
(74) *Attorney, Agent, or Firm* — Dan Fiul

(57) ABSTRACT

An apron rack system includes a support frame, and at least two paired support arms attached to the support frame. The apron rack system includes at least one set of paired rungs projecting toward each other, attached to the at least two paired support arms, and providing an open space between the paired rungs through which a garment is hung from each of the paired rungs.

10 Claims, 5 Drawing Sheets

SYSTEM FOR HANGING AND STORING X-RAY LEAD APRONS

This application claims priority from U.S. Provisional Patent Application 61/357,632 to Mark Alcock, filed Jun. 23, 2010, entitled "SYSTEM FOR HANGING AND STORING X-RAY LEAD APRONS", the entirety of which is expressly incorporated herein by reference.

BACKGROUND OF THE INVENTION

1. Field of the Invention

The present invention relates to garment hanging and storage. More particularly, it relates to an x-ray lead apron rack system for hanging and storing x-ray lead aprons.

2. Background of Related Art

Exposure to radiation is an occupational hazard in the healthcare industry. Continuous exposure to radiation can result in serious illness. Each exposure accumulates within the human body, making it imperative that personnel working in a radiation environment be protected from the harmful radiation, such as x-rays. It is also important that this protective equipment be properly stored and maintained so that its protective properties are not compromised.

An x-ray lead apron is a bib-like garment worn by personnel to prevent exposure to radiation from x-ray machines. The lead "layer" of an x-ray apron is typically 0.3 to 0.5 millimeters thick and is laminated within the apron fabric. The x-ray lead apron is usually sleeveless and hangs from the wearer's shoulders extending to just above the knees. An adjustable belt or Velcro strap holds the x-ray lead apron close to the body. Another version of an x-ray lead apron consists of a wraparound "skirt" and accompanying vest. The average weight of the x-ray lead apron is approximately 3.7 kilos (8 pounds). These x-ray lead aprons can include an optional thyroid shield, which is a collar designed to hang along the front of the neck to protect the thyroid gland. Sometimes the manufacturer will tether the thyroid shield to the x-ray lead apron to help prevent loss of the thyroid shield. However, the thyroid shields are sometimes removed from the tether and eventually lost or tossed into a drawer out of sight.

Due to the fragile nature of the thin lead layer within the fabric of the x-ray lead apron, it becomes crucial that the x-ray lead apron be stored in a manner that prevents wrinkling and/or folding when not in use. Wrinkling and/or folding will eventually create cracks in the lead component, and subsequently allow the passage of radiation through the apron, defeating the purpose of wearing the protection.

In a medical/surgical setting where radiation is used, the x-ray lead apron and thyroid shield may be worn for several hours at a time by staff members and patients receiving care. As a result of the continuous contact of the x-ray lead apron to the staff member, the x-ray lead apron often becomes damp from the wearer's perspiration. Thus, best practices imply that the x-ray lead apron be disinfected and stored in a fashion to facilitate either active or passive air flow for drying the apron. However, at the end of sometimes hours wearing an x-ray lead apron, wearers typically remove their x-ray lead apron and drape it over a chair or table, thus introducing bends and potential cracks as well as preventing airflow around the x-ray lead apron.

Products exist that address these issues, but achieving these results requires patience and strength from the end user. Moreover, conventional systems for hanging and storing x-ray lead aprons commonly share the characteristic that they hang x-ray lead aprons on pegs, support frame or other support system. With a limited width based on storage considerations, x-ray lead aprons are forced together by design, resulting in bunching and its accompanying shortcomings, as described herein.

For example, a conventional wall mounted system (not shown) for hanging and storing x-ray lead aprons includes a wall support frame onto which a plurality of pegs are attached perpendicular thereto. The width of this conventional wall mounted system for hanging and storing x-ray lead aprons is relatively small relative to the number of x-ray lead aprons that can be stored thereon. By design, this small width produces the deficiencies associated with conventional wall mounted systems for hanging and storing x-ray lead aprons discussed above. Medical personnel with a desire to remove a single x-ray lead apron from a plurality of hanging x-ray lead aprons are usually faced with a tangled mess. De-tangling of heavy x-ray lead aprons is a major undertaking, adding unneeded stress to personnel already working in a stressful environment.

The plurality of pegs of the conventional wall mounted system are spaced to promote medical personnel to place an x-ray lead apron "sleeve" on each peg. Each peg is only long enough to hold one sleeve, or one half of an x-ray lead apron. Placement of a plurality of x-ray lead aprons on the conventional wall mounted system for hanging and storing x-ray lead aprons results in the plurality of x-ray lead aprons being bunched together. Bunching together, as discussed above, prevents the plurality of x-ray lead aprons from drying in a timely manner, encouraging molding and/or odoriferous odors. Likewise, bunching, as discussed above, can introduce cracks in the lead component, and subsequently allow the passage of radiation through the apron, defeating the purpose of wearing the protection.

Other conventional systems for hanging and storing x-ray lead aprons (not shown) rely on clothes hanger type hangers pivotally mounted on a plate system similar to the wall support frame discussed above. The clothes hanger type hangers protrude outward from the wall toward a user in a manner similar to the pegs discussed above.

Another popular storage rack design is similar to the mobile garment or wardrobe racks used in the retail clothing industry. These racks require the user to hang an eight (8) pound x-ray lead apron on a heavy gauge wire coat hanger that is attached to the rack. The hangers can easily tangle with one another, and require two hands to untangle them. With an x-ray lead apron already in hand, the inconvenience and time investment in returning the x-ray lead apron to its hanger can result in personnel avoiding the racks and subsequently folding an apron over the back of a chair, hanging it from a door knob, dropping it on the floor in a corner, etc. Furthermore, conventional mobile apron storage racks stand on wheels that are usually broken or too small in diameter, discouraging the end user from transporting the rack to a needed location.

Accordingly, there is a need for an x-ray apron hanging and storage system which allows for easy hanging of x-ray lead aprons and that prevents the aforementioned improper use of a storage system which results in tangling, bunching, and/or discourages improper airflow that promotes drying.

SUMMARY OF THE INVENTION

An apron rack system includes a support frame, and at least two paired support arms attached to the support frame. The apron rack system includes at least one set of paired rungs projecting toward each other, attached to the at least two paired support arms, and providing an open space between the paired rungs through which a garment is hung from each of the paired rungs.

BRIEF DESCRIPTION OF THE DRAWINGS

Features and advantages of the present invention will become apparent to those skilled in the art from the following description with reference to the drawings, in which.

DETAILED DESCRIPTION OF ILLUSTRATIVE EMBODIMENTS

Figure 1:
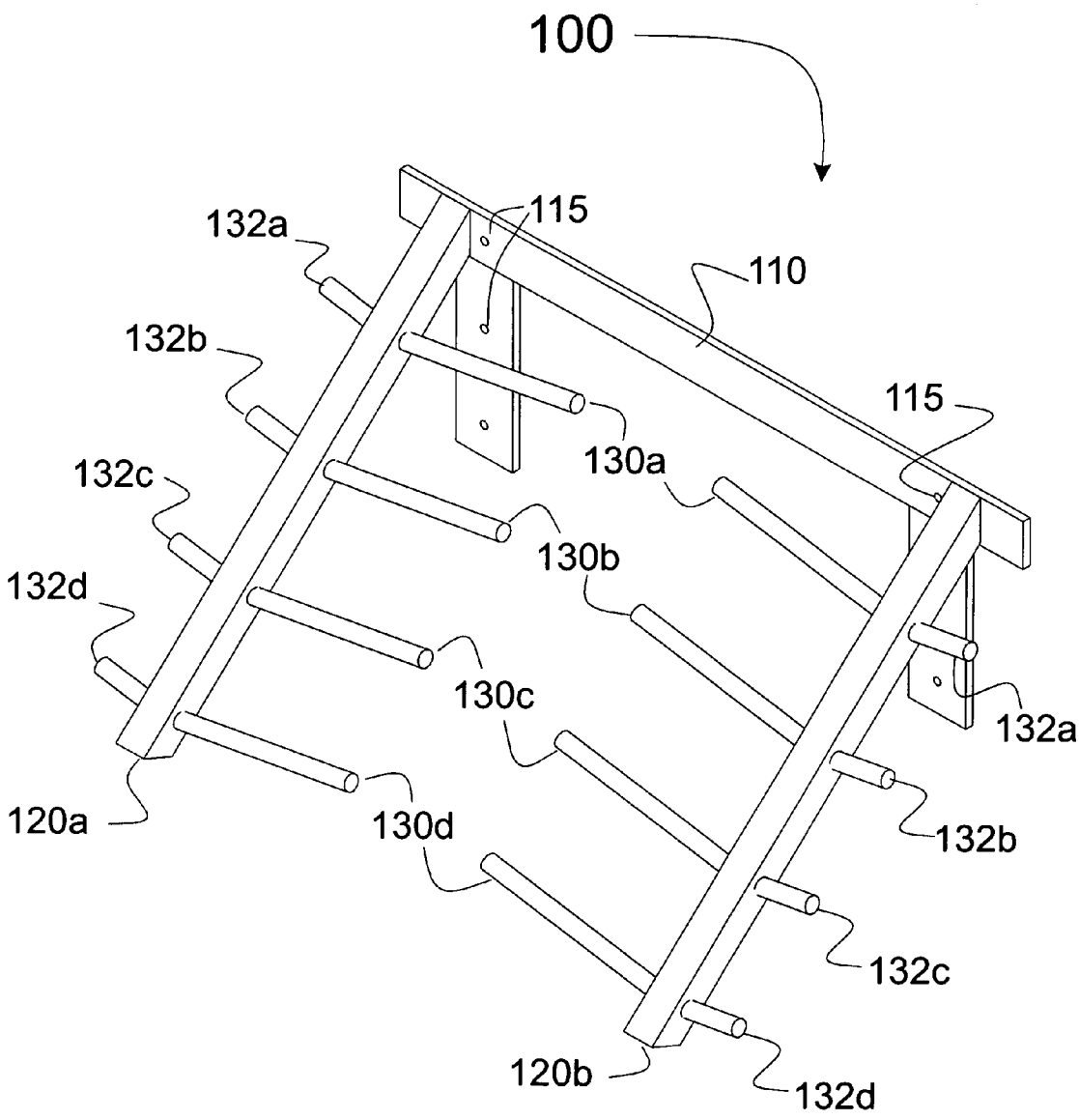
FIG. 1 illustrates an isometric view of an embodiment of a wall mountable x-ray lead apron rack system, in accordance with the principles of the present invention.

In accordance with the principles disclosed herein, a novel system for hanging and storing x-ray lead aprons hangs x-ray lead aprons without allowing the x-ray lead aprons to touch one another or minimally touch one another. Because the x-ray lead aprons are prevented from touching one another or minimally touch one another by design, bunching is prevented, along with the problems associated with bunching that include molding, odoriferous odors, and/or possible introduction of cracks in the lead component of aprons hanged thereon.

In accordance with the principles disclosed herein, a novel system for hanging and storing x-ray lead aprons allows easy removal of individual x-ray lead aprons while a plurality of x-ray lead aprons are being stored thereon.

The innovative design of the new x-ray lead apron storage rack system disclosed herein allows a user to easily hang x-ray lead aprons from a series of paired rungs mounted at a fixed distance on the rack. The paired rungs are mounted opposite one another on two diagonal bars spaced far enough to allow the aprons to fit between them. The paired rungs are also angled slightly upwards to conform to the natural angle of the shoulder portion of the apron, preferably at approximately ten degrees relative to a horizontal plane.

The paired rungs of the novel x-ray lead apron hanging and storing system disclosed herein are spaced so that when the rack is full of x-ray lead aprons passive air flow surrounds the x-ray lead aprons to speed drying of any damp material. The paired rungs can also continue through the diagonal bars to form thyroid shield rungs that allow for hanging of derelict thyroid shields. These thyroid shield rungs can also be angled slightly upward, and optionally include placement of a small tab or stop of some sort to prevent the shield from falling off the rungs. Similarly, the paired apron rungs could be tabbed instead of angled. However, angled paired rungs provide a more ergonomic fit and reduce stress to the aprons' shoulder sections while being stored.

Facing the x-ray lead apron rack system disclosed herein, a tiered rung configuration allows view of the x-ray lead aprons stored on the paired rungs and view of which rungs are available for storage of additional x-ray lead aprons.

In one embodiment disclosed herein, a side view of the x-ray lead apron rack system disclosed herein has an A-frame appearance. The A-frame design allows a stronger and tighter construct, enabling more storage space per given area.

A highlight of the x-ray lead apron rack system disclosed herein is the paired rung design. This paired rung design presents a reverse approach to how x-ray lead aprons are conventionally hung. Instead of stretching the neck and shoulder portions of the x-ray apron around a hanger as if hanging a jacket, the sleeveless apron is placed over each of the paired rungs from the shoulder's edge, thus sliding the shoulders of the x-ray apron laterally across its respective rung. This open design makes any pair of rungs accessible anytime, allowing a typical user to remove or replace an apron with one hand.

The novel x-ray lead apron hanging design disclosed herein can hang as many aprons as conventional wardrobe-style racks use, while requiring approximately half the floor space. This smaller footprint results in a more stable, less top heavy and safer piece of equipment. Preferably, the x-ray apron rack system disclosed herein can accommodate for storage of nine x-ray aprons in an approximately two feet by two feet square space.

The new x-ray apron rack design disclosed herein utilizes larger wheels than conventional x-ray apron rack systems, which significantly reduces rolling resistance. Personnel can easily roll the x-ray apron rack system disclosed herein to a needed location. Typically, a person tasked with procuring x-ray lead aprons for a surgical team will remove them from the conventional rack and stack them on a small table to transport to an operating room. This action introduces bends and potential crack development of the lead layer, rendering the apron useless. Because x-ray lead aprons are purchased for approximately $300.00 apiece, any medical facility utilizing x-ray devices would welcome a more user friendly storage rack that not only promotes proper storage and care of the apron, but by default increases the lifespan of the apron, thus lowering overall capital costs.

FIG. 1 illustrates an isometric view of an embodiment of a wall mountable x-ray lead apron rack system, in accordance with the principles of the present invention.

In particular, as shown in FIG. 1, the wall mountable x-ray lead apron rack system 100 can include a wall support frame 110, paired diagonal support arms 120*a* and 120*b*, and paired rungs 130*a*-130*d*.

In accordance with the principles disclosed herein, the wall mountable x-ray lead apron rack system 100 includes paired rungs 130*a*-130*d* that project toward one another from paired diagonal support arms 120*a* and 120*b*. Importantly, the paired rungs 130*a*-130*d* are each approximately nine inches in total length, with approximately one inch contained inside or passing through the diagonal support arms 120*a* and 120*b*, approximately six inches extended toward center from the inside edge of the diagonal support arms 120*a* and 120*b*, and approximately two inches extending from the outside edge of support arms 120*a* and 120*b* and serving as optional thyroid shield hangers 132*a*-132*d*, discussed below. The subsequent opening created between paired rungs 130*a*-130*d* provides the unique system disclosed herein for hanging x-ray lead aprons. An x-ray lead apron is extended between the paired rungs 130*a*-130*d*, with a shoulder portion of an x-ray lead apron being hung on any of the respective paired rungs 130*a*, paired rungs 130*b*, paired rungs 130*c*, and paired rungs 130*d*. In the preferred embodiments, the paired rungs 130 are attached every 3.75 inches along the paired support arms 120, with the space opening between paired rungs 130*a*-130*d* being approximately 5 inches.

The wall support frame 110 can include any number of mounting holes 115 to allow the wall support frame 110 to be secured to a wall. Preferably, the mounting holes 115 are placed near the corners of the wall support frame 110, but can be placed at any location that provides easy mounting of the wall mountable x-ray lead apron rack system 100. Alternately, the wall support frame 110 can include mounting brackets (not shown) that attach to wall mountable mounting brackets. Wall brackets can be attached to beams within the wall to assist in securing the x-ray lead apron rack system 100 to a wall. Depending upon the type of wall that the x-ray lead apron rack system 100 is being attached to, any number of wall fasteners can be used to fasten the x-ray lead apron rack system 100 to a wall. For example, the wall mountable x-ray lead apron rack system 100 can be attached to a vertical surface with screws, welds, nails, industrial adhesive, etc.

Irrespective of the fastening system used to mount the wall mountable x-ray lead apron rack system 100 to a wall, care must be taken to ensure that the wall mountable x-ray lead apron rack system 100 is mounted securely enough to hold the number of x-ray lead aprons so designated.

The wall mountable x-ray lead apron rack system 100 can optionally include thyroid shield pegs 132*a*-132*d*. Although FIG. 1 shows thyroid shield pegs 132*a*-132*d* respectively attached to paired diagonal support arms 120*a* and 120*b*, the wall mountable x-ray lead apron rack system 100 can include thyroid shield pegs 132*a*-132*d* only on diagonal support arm 120*a* or only on support arm 120*b*. The thyroid shield pegs 132*a*-132*d* are preferably angled slightly upward, preferably at approximately ten (10) degrees, to minimize thyroid shields from falling off of the thyroid shield pegs 132*a*-132*d*.

In the embodiment of FIG. 1, the x-ray lead apron rack system 100 is shown with the capacity of holding four x-ray lead aprons, but can be manufactured to hold more or less x-ray lead aprons depending upon needs. The actual number of x-ray lead aprons that the wall mountable x-ray lead apron rack system 100 can hold is only limited by the length of the pair of diagonal support arms 120*a* and 120*b*.

For example, a small medical office that may only have one x-ray lead apron, typically shared throughout the office, may order the x-ray lead apron rack system 100 with only a single paired rung 130*a*. The wall mountable x-ray lead apron rack system 100 that includes only a single paired rung 130*a* would likewise include paired diagonal support arms 120*a* and 120*b* that are shortened to only accommodate a single paired rung 130*a*. Likewise, with an x-ray lead apron rack system 100 that includes more than the exemplary four paired rungs 130*a*-130*d* shown in FIG. 1, the paired diagonal support arms 120*a* and 120*b* can be extended to support additional paired rungs 130.

The relative angle between the wall support frame 110 and paired support arms 120*a* and 120*b* can be either positive or negative relative to a horizontal plane. In the embodiment shown in FIG. 1, the relative angle between the wall support frame 110 and paired diagonal support arms 120*a* and 120*b* is at a negative angle of approximately 45 degrees relative to a horizontal plane. Although the relative angle between the wall support frame 110 and paired diagonal support arms 120*a* and 120*b* can be perpendicular, i.e., horizontal, the preferred embodiments disclosed herein use a positive or negative angle relative to a horizontal between the wall support frame 110 and paired diagonal support arms 120*a* and 120*b* to allow easy viewing of which paired rungs 130*a*-130*d* are being used and which paired rungs 130*a*-130*d* are open to store an x-ray lead apron.

In an alternate embodiment, the wall mountable x-ray lead apron rack system 100, shown in FIG. 1, can fold down on itself to facilitate ease of shipping. Once affixed to a wall, the wall mount x-ray apron rack system 100 can be permanently locked at an angle relative to a wall to allow hanging and storing of x-ray lead aprons.

In yet another alternate embodiment, the wall mountable x-ray lead apron rack system 100, shown in FIG. 1, can be configured at a fixed angle relative to a wall. Alternately, the wall mountable x-ray lead apron rack system 100 can include a hinge at the junction where the paired diagonal support arms 120*a* and 120*b* and the wall support frame 110 meet to allow the wall mountable x-ray lead apron rack system 100 to fold down against a wall when not in use.

Figure 2:
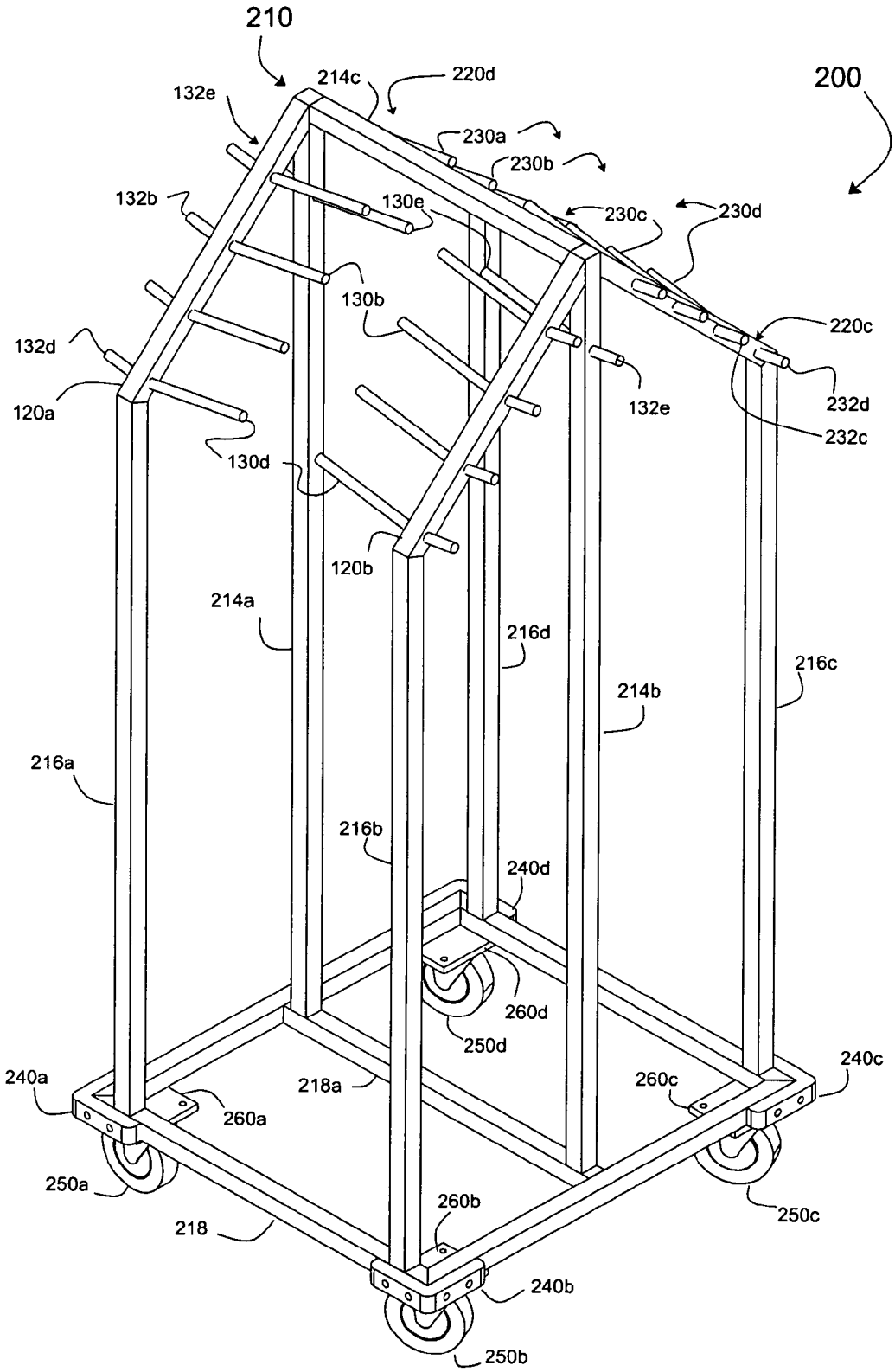
FIG. 2 illustrates an isometric view of an embodiment of a mobile x-ray lead apron rack system, in accordance with the principles of the present invention.

FIG. 2 illustrates an isometric view of an embodiment of a mobile x-ray lead apron rack system, in accordance with the principles of the present invention.

In particular, as shown in FIG. 2, the mobile x-ray lead apron rack system 200 can include front paired diagonal support arms 120*a* and 120*b*, rear paired diagonal support arms 220*c* and 220*d*, and front paired rungs 130*a*-130*d* with optional thyroid shield rungs 132*a*-132*d*, rear paired rungs 230*a*-230*d* with optional thyroid shield rungs 232*a*-232*d*, central paired rungs 130*e* with optional thyroid shield rungs 132*e*, and a support frame 210. The support frame can include a horizontal frame member 214*c*, vertical frame members 214*a* and 214*b*, and optional paired rung vertical support members 216*a*-216*d*. The support frame 210 and paired rung vertical support members 216*a*-216*d* are supported by base frame 218 and base cross member 218*a*.

The description of FIG. 1 for paired diagonal support arms 120*a* and 120*b* and paired rungs 130*a*-130*d* applies equally to the correspondingly numbered items in FIG. 2. Likewise, the description for paired diagonal support arms 120*a* and 120*b* and paired rungs 130*a*-130*d* above applies equally to the paired diagonal support arms 220*c* and 220*d* and the paired rungs 230*a*-230*d*. For brevity, the description above for paired diagonal support arms 120*a* and 120*b* and paired rungs 130*a*-130*d* will not be repeated below for paired rungs 230*a*-230*d* and paired diagonal support arms 220*c* and 220*d*.

Although described herein as front paired rungs 130*a*-130*d* and rear paired rungs 230*a*-230*d*, the mobile x-ray lead apron rack system 200 is symmetric front to back and side to side. Simply turning the mobile x-ray lead apron rack system 200 180 degrees would place the front paired rungs 130*a*-130*d* at the rear of the mobile x-ray lead apron rack system 200, and likewise, the rear paired rungs 230*a*-230*d* at the front of the mobile x-ray lead apron rack system 200. Additionally, central paired rungs 130*e* are housed in vertical frame members 214*a* and 214*b* and remain centrally located regardless of orientation.

The exemplary mobile x-ray lead apron rack system 200 includes both front paired rungs 130*a*-130*d* and rear paired rungs 230*a*-230*d*. The description herein for the front paired rungs 130*a*-130*d* applies equally to the rear paired rungs 230*a*-230*d*.

Although the mobile x-ray lead apron rack system 200 is shown as being symmetric with x-ray lead apron storage on both the front and the back thereof, depending upon the number of x-ray lead aprons that a particular facility requires, the mobile x-ray lead apron rack system 200 can be manufactured to include only the front paired rungs 130*a*-130*d* and their accompanying paired rung support members 216*a*-216*d*.

The horizontal frame member 214*c* provides structural support and serves to tie the framework together. Vertical frame members 214*a* and 214*b* provide central support and an attachment point for diagonal support arms 120*a* and 120*b* and rear diagonal support arms 220*c* and 220*d*. Depending upon the number of x-ray lead aprons that the mobile x-ray lead apron rack system 200 is configured to hold, the mobile x-ray lead apron rack system 200 can include optional paired rung vertical support members 216*a*-216*d*. Although not required for support of the paired rungs 130*a*-130*d* and paired rungs 230*a*-230*d*, the paired rung vertical members 216*a*-216*d* are preferably attached to the paired rungs 130*a*-130*d*, paired rungs 230*a*-230*d*, and base frame 218 for easy maneuvering of the mobile x-ray lead apron rack system 200. The paired rung vertical support members 216*a*-216*d* provide convenient places for medical personnel to grasp the mobile x-ray lead apron rack system 200, while simultaneously eliminating spearing of medical personnel with an unsecured bottom of the diagonal support arms 120*a*-120*d*.

In the preferred embodiments, the overall height of the mobile x-ray lead apron rack system 200 remains constant irrespective of the number of paired rungs 130 that the mobile x-ray lead apron rack system 200 includes. Preferably, the mobile x-ray lead apron rack system 200 overall height is approximately 59 inches above the ground to maintain a low center of gravity and to provide ergonomic access of the paired rungs 130 to personnel of all heights.

In the preferred embodiments, the base frame 218 and base cross member 218*a* of the mobile x-ray lead apron rack system 200 can be an open framework to provide a mounting surface for the wheels 250*a*-250*d* while providing rigidity for attachment of the other components described herein. Alternately, the base frame 218 and base cross member 218*a* of the mobile x-ray lead apron rack system 200 can be covered with a thin piece of metal or other material approved for the environment in which it will be used. The covering would provide a more aesthetically pleasing piece of equipment, however, an open framework design provides more open area for passive airflow around stored x-ray lead aprons.

The base frame 218 can include corner bumpers 240*a*-240*d* attached thereto. The preferred bumper would consist of a non-marking substance, i.e. rubber, that would prevent damage both to the mobile x-ray lead apron rack system 200 and to any object or structure it may come in contact with.

Conventional x-ray lead aprons use wheels that are too small in diameter and easily get caught on even small floor imperfections and obstacles. To facilitate mobility over both small and large floor imperfections and obstacles, the mobile x-ray lead apron rack system 200 can be constructed with wheels 250*a*-250*d* that are at least approximately four inches in diameter.

Mounting plates 260*a*-260*d* can be included to allow for the mounting of the wheels 250*a*-250*d* to the base frame 218. Mounting plates 260*a*-260*d* are preferably attached to the base frame 218 through welding. However, mounting plates 260*a*-260*d* can be attached to the base frame 218 with screws, rivets, or any other fastening system that prevents movement between the mounting plates 260*a*-260*d* and the base frame 218.

Figure 3:
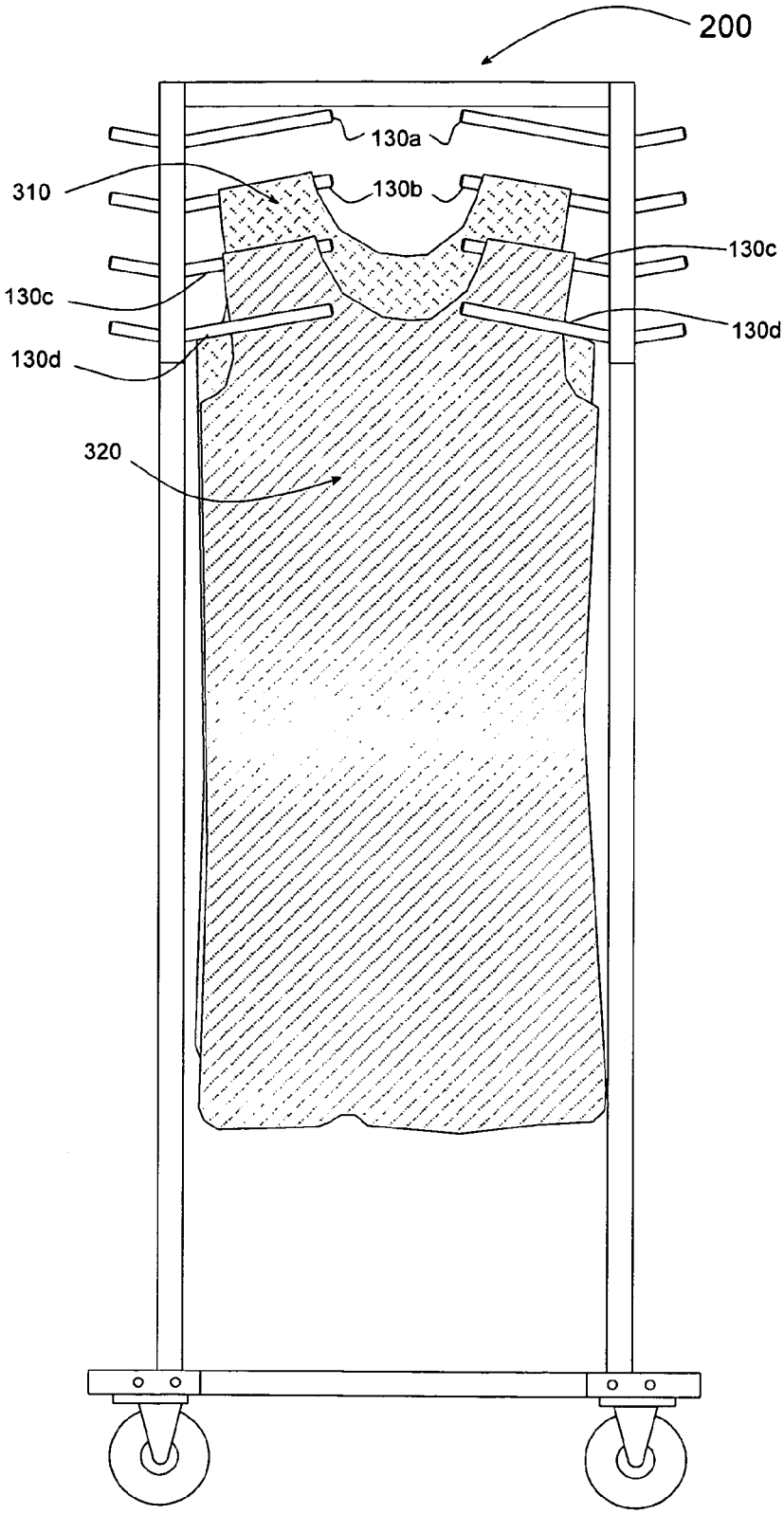
FIG. 3 illustrates the mobile x-ray lead apron rack system shown in FIG. 2 with x-ray lead aprons hanging therefrom, in accordance with the principles of the present invention.

FIG. 3 illustrates a mobile x-ray lead apron rack system with x-ray lead aprons hanging therefrom, in accordance with the principles of the present invention In particular, as shown in FIG. 3, the mobile x-ray lead apron rack system 200 is shown storing a first x-ray lead apron 310 and a second x-ray lead apron 320. To facilitate an understanding of the relative distance between hanging x-ray lead aprons, the paired rungs 130*d* furthest forward are left empty. In accordance with the principles disclosed herein, medical personnel can hang the first x-ray lead apron 310 by reaching between the front paired rungs 130*a*-130*d* to the paired rungs 130*b*. Likewise, medical personnel can hang the second x-ray lead apron 320 by reaching between the front paired rungs 130*b*-130*d* to the paired rungs 130*c*. Medical personnel can hang a third x-ray lead apron by reaching behind the front paired rungs 130*b*-130*d* and to the paired rungs 130*a*.

From the front view of the mobile x-ray lead apron rack system 200, medical personnel can only access the furthest forward front paired rungs 130 that are not currently hanging an x-ray lead apron. However, medical personnel approaching the mobile x-ray lead apron rack system 200 from the side still have free access to any of the front paired rungs 130*a*-130*d* or any of the rear paired rungs 230*a*-230*d*.

The paired diagonal support arms 120*a* and 120*b*, the paired diagonal arms 220*c* and 220*d*, and the front paired rungs 130*a*-130*d*, the rear paired rungs 230*a*-230*d*, the horizontal frame member 214*c*, the vertical frame members 214*a* and 214*b*, the optional paired rung vertical support members 216*a*-216*d*, and the base frame 218 and base cross member 218*a* are preferably attached to their corresponding components through welding. However, other forms of attachment can be used that include screws, bolts, industrial adhesive, spring loaded clips, threaded fittings, etc.

Figure 4:
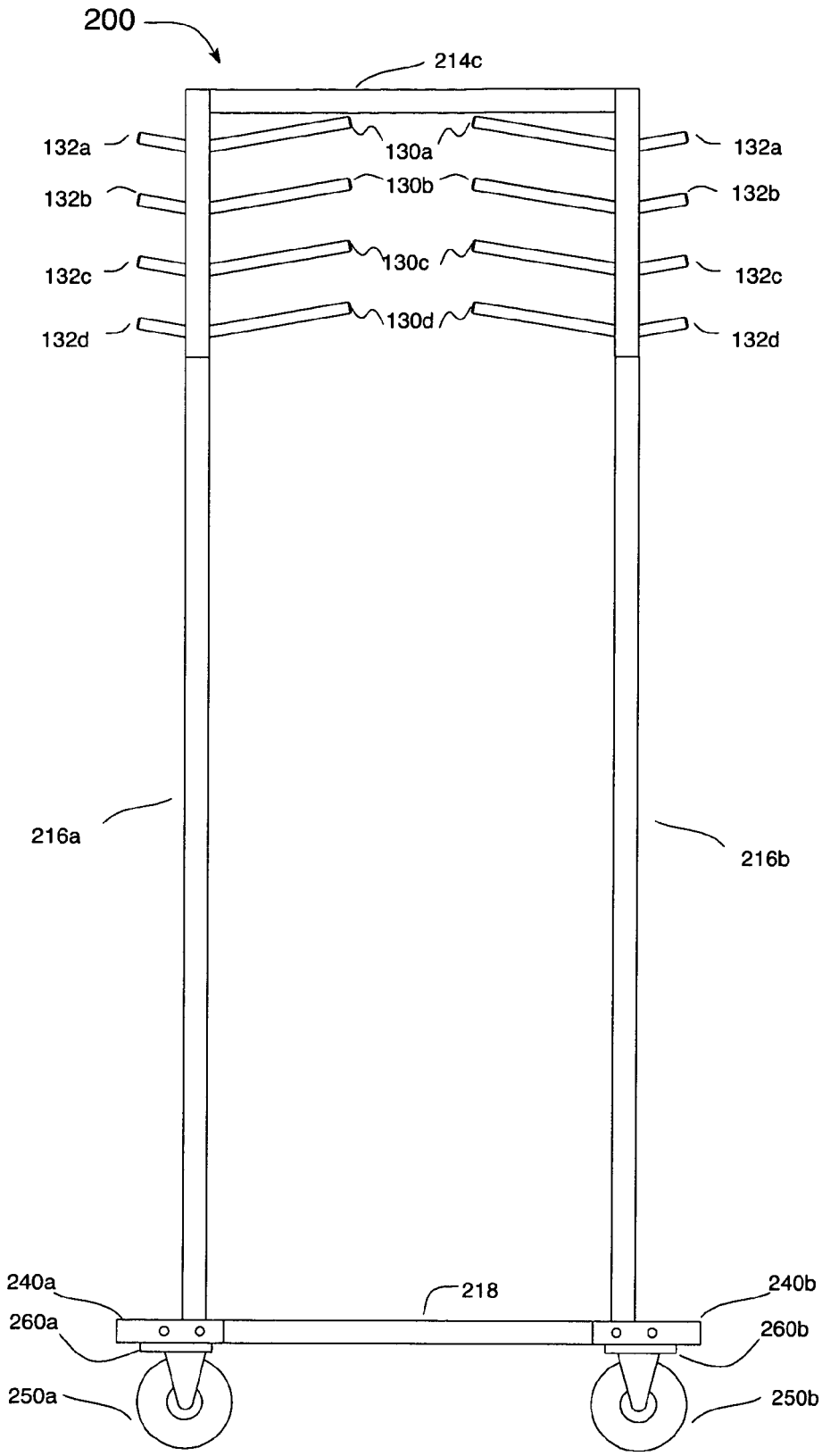
FIG. 4 illustrates a front view of the mobile x-ray lead apron rack system shown in FIG. 2, in accordance with the principles of the present invention.

FIG. 4 illustrates a front view of an embodiment of a mobile x-ray lead apron rack system, in accordance with the principles of the present invention.

Figure 5:
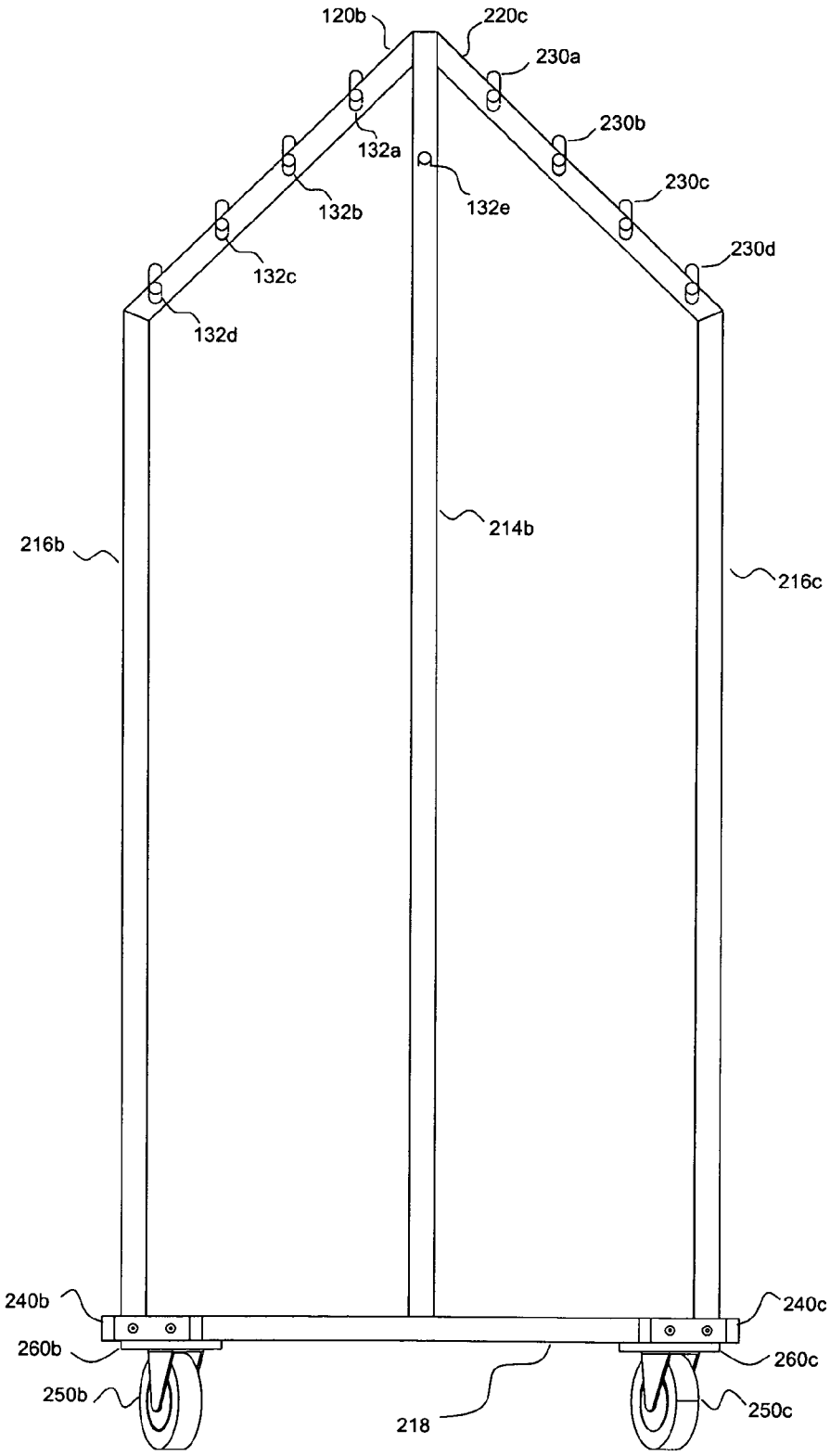
FIG. 5 illustrates a side view of the mobile x-ray lead apron rack system shown in FIG. 2, in accordance with the principles of the present invention.

FIG. 5 illustrates a side view of an embodiment of a mobile x-ray lead apron rack system, in accordance with the principles of the present invention.

Another embodiment of the novel x-ray lead apron rack system disclosed herein includes hanging of a lead curtain from the apex of the x-ray lead apron rack system for personnel who need intermittent protection from harmful radiation. Alternately, a solid lead barrier could also be configured thereon. Conventional barriers exist with these features independently, but without allowing for apron storage. Thus, the novel x-ray lead apron rack system disclosed herein can double as an x-ray lead apron storage rack and as a temporary shield from radiation, saving the end user the expense and space required for two separate pieces of equipment.

Another embodiment of the novel x-ray lead apron rack system disclosed herein can include attachment of Plexiglas, or some other translucent material to the novel x-ray lead apron rack system disclosed herein, to serve as a window for viewing a procedure while simultaneously providing protected from radiation. This window can have a thin coating of lead that is thin enough to see through, but thick enough to repel any gamma radiation directed towards personnel standing behind the lead-coated substrate. Again, conventional systems exist that incorporate a solid barrier below with a window above, but none that accommodate x-ray lead apron storage.

The x-ray lead apron rack disclosed herein can accommodate more or less x-ray lead aprons than shown in FIGS. 2-5 without increasing the height of the novel x-ray lead apron rack system disclosed herein. However, personnel safety should be considered when increasing the size of the rack due to the weight of the x-ray lead aprons. Additional paired rungs can be placed on extended diagonal bars at the lower portion of each side of the x-ray lead apron rack system disclosed herein to allow storage for two more x-ray lead aprons. A similar configuration can place a pair of rungs with an associated x-ray lead apron hanging perpendicular to the x-ray lead aprons shown in FIG. 3. These paired rungs can extend outwards from the sides of the x-ray lead apron rack system disclosed herein. Additionally, a pair of rungs can be placed below the top of the x-ray lead apron rack system to allow storage of an additional apron, as demonstrated by central paired rungs 130*e* in FIG. 2.

Yet another embodiment can include mounting of a small fan or series of small fans along the base frame 218, base cross member 218*a* or along the sides of the x-ray lead apron rack system disclosed herein pointing upwards or sideways respectively to provide active air flow around hanging x-ray lead aprons.

An alternate embodiment of the mobile apron rack system can entail an "assembly required" package, such that the x-ray lead apron rack system can be shipped in a minimal sized box. An end user would basically "snap" the x-ray apron rack system together, preferably so that it could not be easily disassembled.

While the invention has been described with reference to the exemplary preferred embodiments thereof, those skilled in the art will be able to make various modifications to the described embodiments of the invention without departing from the true spirit and scope of the invention.

What is claimed is:

1. A garment rack system to hang a garment comprised of a shoulder portion, comprising:

a support frame;

at least two paired support arms attached to said support frame, said two paired support arms being at a fixed angle with respect to a horizontal plane; and at least one set of paired shoulder portion hanging rungs projecting toward each other, each rung of said at least one set of paired shoulder portion hanging rungs respectively attached to a support arm of said at least two paired support arms, and providing an open space between said at least one set of paired shoulder portion hanging rungs through which said shoulder portion of said garment is hung from each rung of said at least one set of paired shoulder portion hanging rungs.

2. The garment rack system according to claim 1, wherein: said support frame is wall mountable.

3. The garment rack system according to claim 1, wherein: said support frame is comprised of wheels.

4. The garment rack system according to claim 1, wherein: said garment is an x-ray lead apron.

5. The garment rack system according to claim 1, wherein: said at least two paired support arms are rigidly attached to said support frame.

6. The garment rack system according to claim 1, further comprising:

at least one thyroid shield peg attached to at least one of said at least two paired support arms.

7. The garment rack system according to claim 1, wherein: said at least one set of paired shoulder portion hanging rungs is horizontally attached to said at least two paired support arms.

8. The garment rack system according to claim 1, wherein: said at least one set of paired shoulder portion hanging rungs is attached to said at least two paired support arms at approximately a 10 degree angle with respect to a horizontal plane.

9. The garment rack system according to claim 1, further comprising:

bumpers attached to said support frame.

10. The garment rack system according to claim 1, wherein:

said support frame is attached to a wall with screws.

* * * * *